United States Patent [19]

Maher

[11] 4,055,213

[45] Oct. 25, 1977

[54] METHOD FOR MAKING PATTERNS

[76] Inventor: Richard G. Maher, 412 Margo, Tawas City, Mich. 48763

[21] Appl. No.: 718,598

[22] Filed: Aug. 30, 1976

Related U.S. Application Data

[63] Continuation-in-part of Ser. No. 423,010, Dec. 10, 1973, abandoned.

[51] Int. Cl.[2] ..... B22C 7/00

[52] U.S. Cl. ..... 164/45; 204/4; 204/9

[58] Field of Search ..... 164/45, 235, 249; 204/3, 4, 6, 9

[56] References Cited

U.S. PATENT DOCUMENTS

| | | | |
|---|---|---|---|
| 1,570,635 | 1/1926 | Laukel | 164/45 |
| 1,649,312 | 11/1927 | Laukel | 164/75 X |

*Primary Examiner*—Richard B. Lazarus

*Attorney, Agent, or Firm*—Whittemore, Hulbert & Belknap

[57] ABSTRACT

A method is provided for making a pattern comprising a metallic outer shell filled with a fill material. The method includes the steps of first forming a pattern of relatively soft material, then forming a shell as, for example, of plastic, around said wood pattern, and then electroplating a layer of metallic material within the shell to form a second shell which is then removed and in some cases filled with a fill material to provide the final pattern.

1 Claim, 5 Drawing Figures

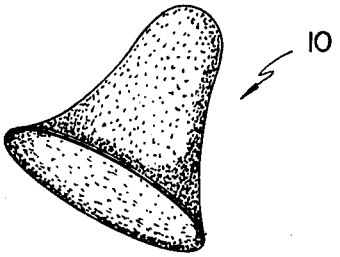
FIG. 1
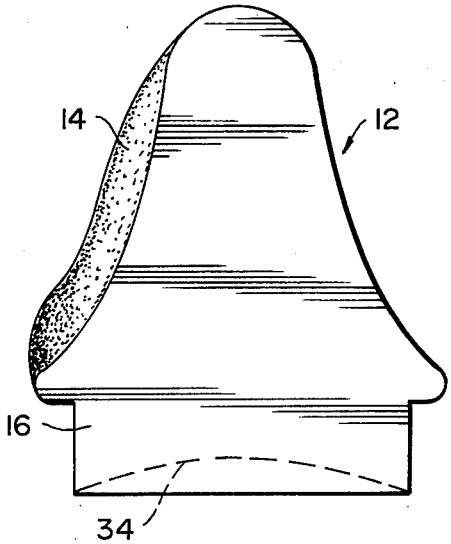
FIG. 2
FIG. 3
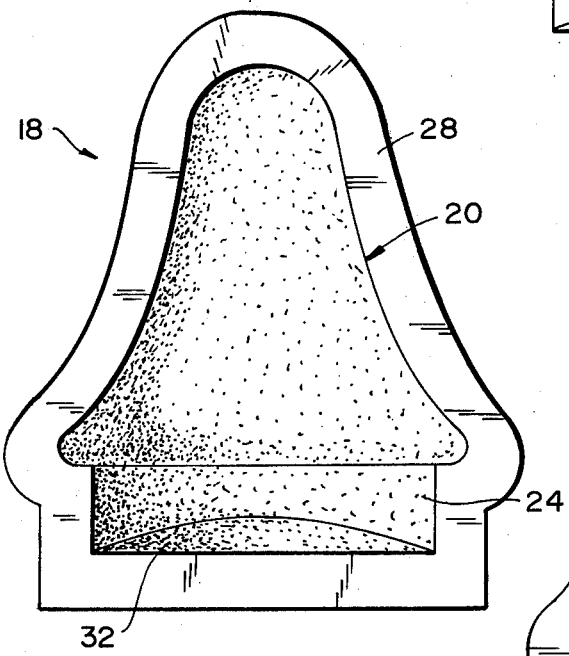
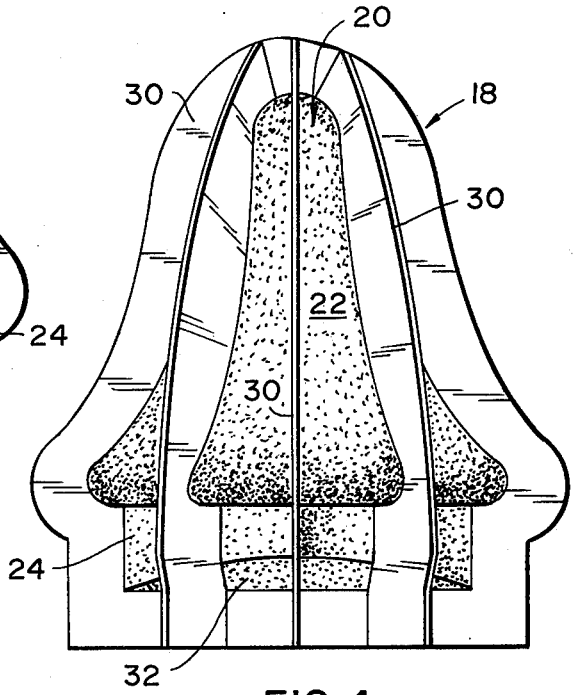
FIG. 4
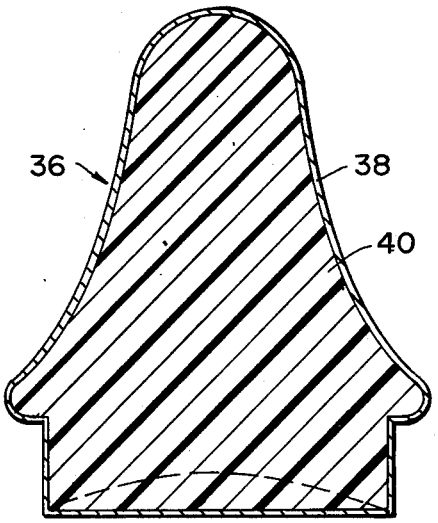
FIG. 5

METHOD FOR MAKING PATTERNS

This application is a continuation-in-part of my application Ser. No. 423,010, filed Dec. 10, 1973, now abandoned.

BACKGROUND OF THE INVENTION

The present invention is particularly adapted for use in connection with making hard patterns, as for example, cast iron patterns of the type commonly used in mass production of, for example, automotive parts. The present method for making such cast iron patterns is costly. Further, repair of cast iron patterns, which is frequently necessary after extensive use, is also very costly.

In the standard method for making a cast iron pattern, a master wood pattern is first made. This master pattern is what is termed a "double shrink" pattern. In casting, the pattern must be so dimensioned as to permit shrinkage to the metal which is cast. In making the conventional cast iron pattern, there is an intermediate step wherein a metallic wood or plastic pattern is made. A second dimensional configuration must be provided in the original master pattern to allow for such additional shrinkage. Additionally, a surplus of metal must be left in order to permit machining operations on the final pattern to finish it for production use.

The master pattern is sometimes used as a pattern in the casting process for making a cast iron or aluminum pattern. A metal pattern is machined to duplicate the original pattern minus one of the shrinks and the material machined off to finish the duplicating model. The duplicating model has sufficient material for one final shrink in the final pattern and for finishing the final pattern by machine operations. A female plastic or metal spotting fixture and male plastic or metal duplicating models are also made in the conventional method.

In the conventional method of making a cast iron pattern, the cast iron pattern that is cast from the wood master pattern is machined from a duplicating model that has only the final single shrink and this duplicating model may be constructed of wood, plastic, or metal. Today plastic is frequently used for duplicating models. More often a separate wood pattern is made to a single shrink and is used to make the plastic duplicating tooling. It may be used also to get an aluminum casting which is used after machining and bench work for duplicating purposes.

The final rough cast iron pattern must be machined, first by means of rough machining in which one of the duplicating models is conventionally used in automated machining processes. The final pattern is finished by bench work, by skilled tradesmen where it is ground, filed and scraped to result in the final, very accurate pattern. As will be appreciated, all of these steps, particularly the final machine and bench steps, are quite expensive.

Additionally, in use, such cast iron patterns do wear considerably as a result of abrasive action of the sand which is used to form molds. It is quite expensive to repair such patterns.

The present invention provides an inexpensive method for manufacturing a pattern which is useful in the same context as conventional patterns. Additionally, the pattern of the present invention is preferably fabricated of a material, such as nickel, which is highly resistant to the abrasive action of sand, thereby providing a long life for the pattern. The use of this method in the manufacture of core boxes should result in the design of much lighter, safer and less expensive core boxes and core machines.

SUMMARY OF THE INVENTION

The pattern of the present invention is made by first fabricating a first pattern of the desired configuration out of relatively soft material. A first shell is then formed around the first pattern. The first pattern is removed from the shell. A metallic second shell is electroplated within the first shell. The second shell is then removed from the first shell and a fill material may then be provided therewith to result in the desired final pattern.

IN THE DRAWINGS

FIG. 1 is a view in perspective of a cast bell manufactured in accordance with the present invention;

FIG. 2 is a view in perspective of one-half of a wood pattern used in the method of the present invention to make a final pattern used in manufacturing the bell of FIG. 1;

FIG. 3 is a front view of a mold made from the pattern of FIG. 2;

FIG. 4 is a rear view of the mold of FIG. 3; and

FIG. 5 is a front view of the final pattern made from the mold of FIG. 3.

The present invention is adapted to make patterns useful in forming molds, normally sand molds, for casting various objects. While the term "pattern" is utilized throughout to describe the final product made in accordance with the invention, this term is to be understood to mean similar devices which may be otherwise designated in the trade, such as core boxes, which are used to form a mold for casting of metals.

Patterns made in accordance with the present invention are particularly useful in connection with forming molds or cores in a method which utilizes sand for forming the mold or core and in which the mold making process is accomplished at elevated temperatures. The elevated temperatures function to cause curing of adherent material mixed in with the sand to result in a final product which is relatively sturdy so as to be able to withstand the stresses encountered in casting.

There are two methods in general use for elevating the temperature of patterns or core boxes. Use of elevated temperatures is most usual in connection with core boxes. However, it is also used in some cases in connection with patterns, as this term is used in its narrower sense in industry. Conventionally, heating is accomplished by burners beneath the pattern or by use of electrical resistance heaters implanted in the pattern.

Temperature ranges in the area of 450° F. are generally recommended. However, in practice, in order to increase production, frequently temperatures of 700° F. and sometimes as much as 1000° F. are encountered. On the lower end, with some new improved materials, it may be feasible to reduce the temperature to 100° F.

The invention is illustratively directed towards making one-half of a pattern for casting a bronze bell 10 illustrated in FIG. 1. As will be appreciated, in the casting of such a bell, it will be necessary to have a complete pattern formed of two of the halves made in accordance with the present invention. Additionally, other elements such as a core, are necessary in order to form a complete mold for the casting of the bell 10.

FIG. 2 comprises a wood pattern which is fabricated by well known art means in the pattern making field. Essentially, such patterns are hand crafted to very accurate dimensions by skilled tradesmen. The pattern 12 forms one-half of the ultimate shape necessary for forming a mold cavity for the exterior surface of the bell 10. Such patterns are also commonly made from other relatively soft materials such as plastic and some of the metals.

The interior surface of the bell is defined in the final mold by means of a core having an exterior surface configured to the desired interior surface of the bell. Such a core is placed within the cavity formed by means of the pattern. The upper portion 14 of the pattern 12 defines the exterior surface of the bell 10. The lower portion 16 is termed a "core print". This portion forms a cavity in the sand mold for reception and positioning of the core. The pattern 12 is designed with excess dimensions to accommodate shrinkage of the metal as it cools and solidifies in the mold. The pattern 12 is termed a "single shrink" pattern because its dimensions are used for only the final casting of the bell 10, there being no intermediate casting steps to form the final pattern as is common in the art. When an intermediate casting step is used, additional dimensions are provided on the pattern 12 to provide for two levels of shrinkage. Such a pattern is termed a "double shrink" pattern.

FIGS. 3 and 4 illustrate a plastic mold 18 made from the pattern 12. The mold 18 includes a thin-walled shell 20 which includes the bell portion and core print portion 24. An exterior flange 28 is provided all around the front periphery of the shell 20. Additionally, a plurality of ribs 30 are provided around the exterior surface. The ribs function to add dimensional stability and strength characteristics to the mold 18. Sometimes it is unnecessary to rib up the plastic shell because it may be possible or more practical to pour the plastic shell used for plating purposes as a solid plastic casting.

As will be noted, the bottom wall 32 of the shell 20 slants upwardly towards the rear of the shell. This angle is designed to assist in positioning a core in the mold which is made by the ultimate pattern. A similar slanted surface 34 is indicated by dotted lines in FIG. 2. Two of the slanted surfaces placed together form a V-shaped recess in the mold which receives a V-shaped lower surface of a core to thereby automatically position the core as desired in the final mold. This is common practice in the molding art.

The mold 18 is, as before stated, fabricated of a plastic material. The plastic material utilized should be one suitable for use in connection with electroplating. For example, an epoxy resin is commonly used for such a purpose. Other resins are well known for use as an electrode in the electroplating art. The interior surface defining the bell 22 and core print 24 are coated with an electrically conductive material such as silver nitrate prior to the electroplating operation to which the mold 18 is subsequently subjected.

Other materials may be used to make the mold 18 as desired and as suitable in the electroforming art. As above stated, the mold 18 is subsequently subjected to electroplating to form a layer of metal on the interior surfaces defining the bell 22 and core print 24.

The reproduction of objects by electrodeposition in a mold is known as electroforming. This process is dependent on the deposition of a metal in the mold. The mold may be metallic or non-metallic. In the case of a metallic mold, the surface of the mold is treated to prevent the adhesion of deposited metal thereon so that the finished object can be removed from the mold. In the case of metal molds, this may be accomplished by coating the surface of the mold with a film of grease or graphite, or by a chemical treatment of the surface to form a thin, uniform film of an insoluble compound. In the case of a non-metallic mold, such as the illustrated mold 18, the object of the treatment of the mold is to render the surface of the mold electrically conductive. In some non-metallic molds, treatment may also be necessary to close up pores in the mold, such as plaster by treatment with shellac, wax, varnish, lacquer, or various plastic fillers. Such a surface may then be made electrically conductive by dusting it with powdered graphite or copper bronze powder. A most commonly used material is silver nitrate.

After treatment of the cavity of the mold 18 to make it electrically conductive, the mold is placed in a plating bath wherein a layer of a metal is deposited on the mold cavity. The process for such plating is well known in the art. Preferably, the interior mold surface is plated with nickel to a thickness of 0.100 inch. Nickel is a preferred metal for fabricating the final pattern 36 illustrated in FIG. 5. Nickel has wear characteristics and strength characteristics which makes it admirably suited for use in connection with a pattern which is subjective to the abrasiveness of sand and the like in the mold making process. However, other metals may be used as desired to suit a particular application taking into consideration characteristics, weight or other characteristics desirable in a given application.

After the interior of the mold is plated, the shell 38 is removed and, as shown in FIG. 5, then filled with a fill material 40. The fill material may be any of numerous materials such as plastic (shown), metals such as lead, lead alloys, zinc, aluminum or bonded sands. Additionally, the shell need not necessarily be completely filled with the fill material. In some instances, merely a partial fill or no fill at all is needed. The final pattern is used in conventional molding techniques to make the bell of FIG. 1.

Patterns of the present invention are capable of use at elevated temperatures, as previously described, with the pattern being substantially unsupported as mentioned above. For example, referring to FIG. 5, the pattern shell 38 may be considered to consist of an outer surface which defines the surface for fabricating a sand mold and an inner surface which is filled with the material 40. As above stated, the pattern may be used at such elevated temperatures with the inner surface being substantially unsupported by the material 40. The reverse proposition would, of course, be true in the case where the inner surface is used to fabricate a sand mold.

I claim:

1. The method of making a pattern and using said pattern in the fabrication of sand molds at elevated temperatures, comprising first fabricating a first pattern of the desired configuration out of relatively soft material, then forming a shell of plastic material on said first pattern, removing the first pattern from said shell, electroplating nickel to a thickness of at least about 0.100 inch on said shell to form a second pattern, the surface thereof consisting of an inner surface and an outer surface, removing said second pattern from the shell, and then using said second pattern as a pattern in the fabrication of sand molds at elevated temperatures, with one of the inner and outer surface of the pattern defining the surface for fabricating a sand mold and the other of said surfaces being substantially unsupported.

* * * * *